United States Patent [19]

Dahlqvist

[11] Patent Number: 4,866,795

[45] Date of Patent: Sep. 19, 1989

[54] PIECE OF SEATING FURNITURE CONVERTIBLE TO BED

[75] Inventor: Bjarne Dahlqvist, Pirilö, Finland

[73] Assignee: OY BD Produkt AB, Finland

[21] Appl. No.: 102,144

[22] PCT Filed: Jan. 21, 1987

[86] PCT No.: PCT/FI87/00009

§ 371 Date: Sep. 11, 1987

§ 102(e) Date: Sep. 11, 1987

[87] PCT Pub. No.: WO87/04326

PCT Pub. Date: Jul. 30, 1987

[30] Foreign Application Priority Data

Jan. 22, 1986 [FI] Finland ..... 860319

[51] Int. Cl.[4] ..... A47C 17/06

[52] U.S. Cl. ..... 5/18 R; 5/37 R; 5/22; 297/68; 297/111

[58] Field of Search ..... 5/18 R, 18 B, 19, 20, 5/21, 22, 23, 17, 37 R, 47, 80; 297/68, 83, 84, 85, 111

[56] References Cited

U.S. PATENT DOCUMENTS

| | | | |
|---|---|---|---|
| 1,634,551 | 7/1927 | Moore | 5/21 |
| 3,169,035 | 2/1965 | Fletcher | 297/85 |
| 3,974,529 | 8/1976 | Johnson | 5/18 R |
| 4,543,675 | 10/1985 | Shrock . | |
| 4,620,335 | 11/1986 | Dodgen | 5/20 |
| 4,669,135 | 6/1987 | Gonzalez | 5/37 R |
| 4,694,514 | 9/1987 | Crossett | 5/18 R |

FOREIGN PATENT DOCUMENTS

| | | | |
|---|---|---|---|
| 173819 | 7/1952 | Austria | 5/17 |
| 178175 | 4/1954 | Austria | 5/19 |
| 232676 | 8/1963 | Austria | 5/47 |
| 954912 | 1/1957 | Fed. Rep. of Germany | 5/47 |
| 1096571 | 1/1961 | Fed. Rep. of Germany | 5/47 |
| 1753006 | 7/1971 | Fed. Rep. of Germany . | |
| 3138598 | 9/1981 | Fed. Rep. of Germany . | |
| 1144777 | 10/1957 | France | 5/47 |
| 2356391 | 1/1978 | France . | |
| 2525094 | 10/1983 | France | 5/37 R |
| 301751 | 9/1954 | Switzerland | 5/19 |
| 445758 | 2/1968 | Switzerland . | |

*Primary Examiner*—Ramon O. Ramirez
*Assistant Examiner*—Robert A. Olson
*Attorney, Agent, or Firm*—McGlew & Tuttle

[57] ABSTRACT

The present invention concerns a piece of seating furniture convertible to bed, comprising a stationary body (1) and at least one articulated frame (2) attached to the body and consisting of a rear back part (3) and a front back part (4) and of a seat part (5) carried on a carriage (14) by means of levers (7, 13). The invention is characterized in that the rear part (3) of the back of the articulated frame (2) is significantly shorter than the front part (4) of its back and, by the intermediate of a further frame part (9), pivotably attached to the stationary body (1) around a transverse shaft (10) provided in the rear part of the body (1), the said further frame part (9) being prevented by stop members (11) from being pivoted to below the horizontal plane. At the front end of the seat part (5), a foot rest (8) in itself known is provided, which can be affected and folded out by means of the position of the levers (7, 13). The carriage (14) which carries the seat part (5) is provided with a pair of wheels (15) resting against the floor (16) at its front end and with a pair of wheels (17) running along linear guides (18) at its rear end, which said guides (18) are arranged in an inclined plane in the lateral parts of the stationary body (1) so that their topmost points are placed at the front edge of the piece of seating furniture.

7 Claims, 3 Drawing Sheets

PIECE OF SEATING FURNITURE CONVERTIBLE TO BED

Figure 1:
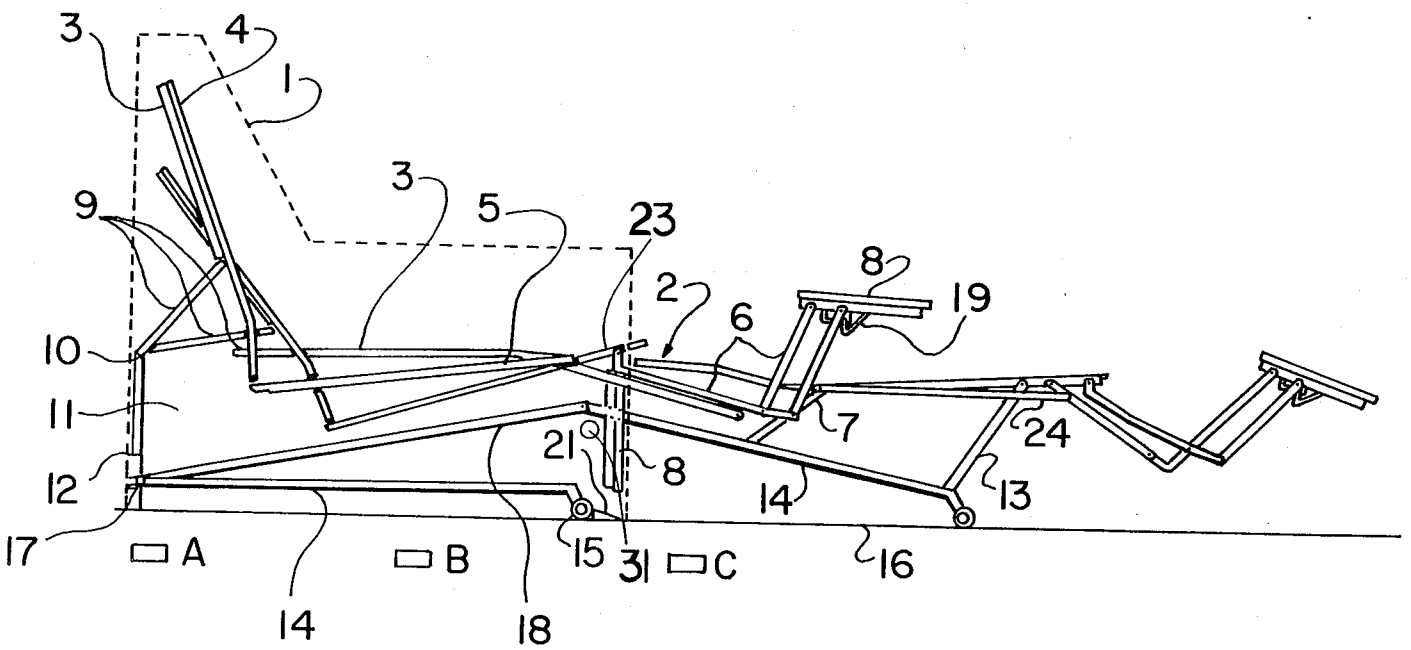

The present invention concerns a piece of seating furniture convertible to a bed, comprising a stationary body and at least one articulated frame attached to the body and consisting of a rear back part and a front back part and of a seat part carried on a carriage by means of levers.

Depending on their principal purpose of use, the prior-art pieces of seating furniture of this type have either provided acceptable seating comfort but lacked any possibility of conversion to the bed position, or the piece of seating furniture has provided good sleeping comfort but very uncomfortable and hard seating comfort. Moreover, all prior-art constructions are highly complicated and require a number of draw and/or press springs in order to operate, which springs tend to become slack or be broken after they have been in operation for a period of time. Moreover, some of the prior-art pieces of seating furniture require expensive telescopic or spring-loaded supporting and carrying frames enabling them to be brought to the bed position.

From the Swiss Pat. No. 445,758, a piece of seating furniture convertible to bed position, of the type mentioned above, is known. In order to obtain a sufficient bed length, it has been necessary to make the dimension of the seat part from the front edge to the back abnormally long. The rear part of the back is also very long, so that in the lowered position it extends relatively far towards the rear from the rear wall of the piece of furniture, as a result of which the rear wall cannot be covered. The construction consists of heavy wooden frames, which make the handling of the piece of seating furniture unduly heavy. In view of making the handling of the piece of seating furniture somewhat easier, the rear part of the back is provided with a particular guide arrangement. This prior-art construction does not permit adjustment of the piece of furniture into a "floating" rest position.

The object of the present invention is to eliminate all of the above problems, which is achieved by means of a piece of seating furniture, which is characterized in that the rear part of the back of the articulated frame is significantly shorter than the front part of its back and, by the interposition of a further frame part, pivotably attached to the stationary body around a transverse shaft provided in the rear part of the body, the said further frame part being prevented by stop members from being pivoted to below the horizontal plane. At the front end of the seat part, a foot rest in itself known is provided, which can be affected and folded out by means of the position of the levers. The carriage which carries the seat part is provided with a pair of wheels resting against the floor at its front end and with a pair of wheels running along linear guides at its rear end, which said guides are arranged in an inclined plane in the lateral parts of the stationary body so that their topmost points are placed at the front edge of the piece of seating furniture.

Further characteristics of the invention come out from the accompanying claims 2 to 10.

Figure 2:
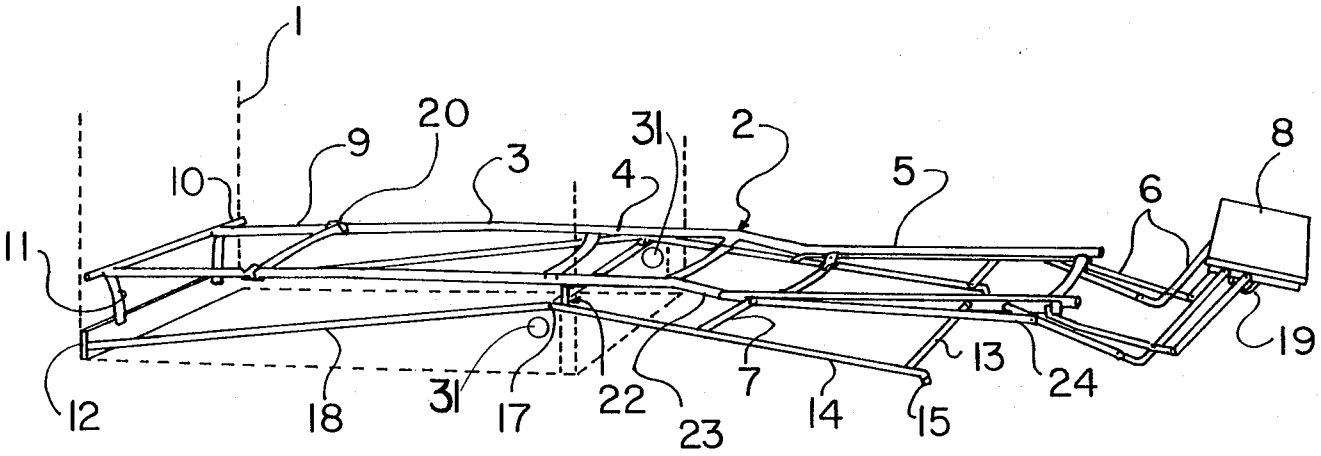
Figure 3:
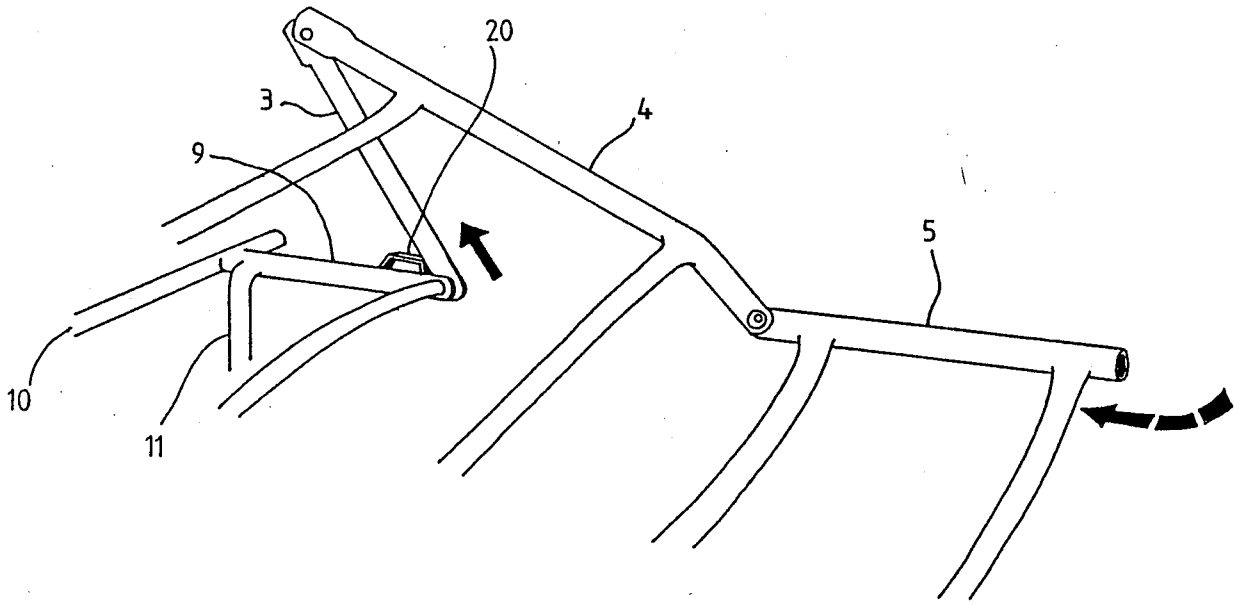

In the following, the invention will be described in more detail with reference to the drawing, wherein FIG. 1 is a schematical side view of an example of a piece of seating furniture in accordance with the invention, with the three main positions shown, FIG. 2 is a more detailed view of the articulated frame in the bed position, and FIG. 3 is a detail view of the articulated frame as it is being folded from the bed position into the rest position and the sitting position.

The piece of seating furniture convertible to bed in accordance with the present invention consists of a stationary body 1 and of at least one articulated frame 2 attached to the body, which said frame comprises a rear part 3 of the back, a front part 4 of the back, which is linked to the rear part 3 of the back and which is again linked to a seat part 5. A foot rest 8, which can be folded out by means of levers 6, 7, is mounted on the seat part 5. The articulated frame 2 is attached to the stationary body 1 by the intermediate of a further frame part 9, which is at one end pivotably attached to the rear part 3 of the back and at the other end attached pivotably around a transverse shaft 10 in the rear part of the stationary body. The rear part 3 of the back is significantly shorter than the front part 4 of the back, its length being appropriately slightly more than half the length of the front part. The frame part 9 is provided with stop members 11, which, being jointly operative with a stop 12 or equivalent in the rear part of the stationary body 1, are arranged so as to stop further pivoting movement of the frame part 9 around the shaft 10 when the part 9 reaches its horizontal position. The seat part 5, which is mounted on the front part 4 of the back, is carried in a way in itself known by two pairs of levers 7, 13, preferably of different lengths, and mounted pivotably at the front end and rear end of the seat part. The novelty in the suspension of the seat part 5 lies therein that the lower ends of the levers 7, 13 are pivotably mounted on a carriage 14, whose front end is provided with a pair of wheels 15 supposed to run along the floor 16 on which the piece of seating furniture is placed, and whose rear end is provided with a pair of wheels 17, which are supposed to run along a pair of guides 18 mounted on the lateral parts of the stationary body 1 so that they are placed in an inclined plane, which is located at the highest level at the front edge of the piece of seating furniture and at the lowest level at its rear edge. When the carriage 14 is being pulled out and wheels 17 run along the guides 18 to their topmost points, the rear portion of the seat part 5 rises so that the seat part 5 becomes positioned substantially horizontally in the same plane in which the other parts of the articulated frame 2 are when the piece of seating furniture is placed in the bed position.

At the front end of the stationary part 1, a lock member 31 of known type is provided. The lock member 31 is operated preferably by engagement with a loop or lever not shown placed at the arm of the piece of seating furniture, and it is arranged so that in the locked position it engages a locking loop 19 on the underside of the foot rest platform to keep the foot rest in the folded-in position and, at the same time, fixes the articulated frame 2 in the normal sitting position A. When the lock member 31 is released, e.g., by pulling the loop or lever and by, at the same time, pushing the upper portion of the back 3, 4 rearwards, the articulated frame can be folded out into a rest position. This very simple and natural maneuvering of the mobile frame is permitted by the back parts 3, 4 of different lengths, which, being jointly operative with the frame part 9, act as two-sided levers. When the upper portion of the back is pushed slightly rearwards, the lower portion of the back and the seat part 5 are thereby pushed forwards at the same time. The rear pair of levers 7 is, by means of a pair of connecting rods 24, connected to the levers 6 at the respective sides, which said levers 6 carry the foot rest 8. The connecting rods 24 are connected to the levers 7 at a point somewhat above the pivotal axes of the levers 7 on the seat part 5. The pivoting movement of the lever 7 is transferred by the connecting rods 24 to the levers 6, which push the foot rest 8 out to the folded-out position B in FIG. 1. The foot rest mechanism 6, 7, 8, 24 is fully known from prior art, but as a result of the lever effect in the back of the present invention, in this piece of seating furniture, a logical and very comfortable maneuvering of the foot rest is obtained.

In order that an optimum sitting comfort should be achieved both in the position A and in the position B, the levers 7 are shorter than the levers 13. This, viz., results therein that the seat part 5, when it is placed into the rest position B, sinks somewhat at the rear edge and rises somewhat at the front edge.

On the top side of the frame part 9, near the articulated joints to the rear part 3 of the back, there are stop members 20, which are arranged so as to stop the pivoting of the said joints when the relative angle between the two frame parts 9 and 3 has reached a predetermined minimum value at which the best rest position is obtained. When the stop members 20 meet the rear part 3 of the back, the support point of the back 3,4, which acts as a lever, is shifted up to the upper joint of the back if an increased inclination of the back is desired. At the same time, the folding-in of the foot rest 8 is faciliated, for when the centre of gravity is shifted somewhat forwards in this position and when the foot rest is, at the same time, pressed down, the lever effect in the whole construction-contributes thereto that very little power is required for this operation.

In order to prevent unintentional pulling of the carriage 14 out of its location within the stationary body 1, a stop face or catch 21 is provided in a suitable location. When the carriage 14 is freed from this catch 21, it can be pulled out to its outer end position, whereat the articulated frame 2 obtains a substantially horizontal bed position. A mattress may be placed appropriately on the padded cushions provided on the articulated frame 2. As a support for the front part 4 of the back, the carriage 14 is provided with a pair of projecting carrying members 22 at its rear edge, on which the said back part 4 rests in the bed position.

In order that a face as unified as possible could be formed underneath the mattress, a flap (not shown) may be mounted by means of further levers on the levers 6, which said further levers and the flap are placed over a transverse bracket at the front edge of the seat part 5.

In order to facilitate the folding-in of the articulated frame from the bed position into the rest and sitting positions, a stop member 23 is provided at each articulated joint between the seat part 5 and the front part 4 of the back. These stop members 23 prevent the angle between the front part 4 of the back and the seat part 5 from becoming larger than 180°. As a result of this, the articulated frame 2 folds upwards at the joint between the two back parts 3, 4 when the foot rest is pressed a little downwards in connection with the pushing inwards. The stop members 20 on the frame part 9 also prevent falling of the back part rearwards against the rear piece of the stationary body 1 on folding-in.

In order to increase the comfort, the arm of the piece of seating furniture may be provided with a sideboard for, e.g., books, newspapers, cup of coffee, glass, lamp, or equivalent.

When the piece of seating furniture is provided with two seats and beds, a narrow intermediate piece is preferably mounted between the two articulated frames 2, which said intermediate piece is at both sides provided with a guide for a rear wheel of the carriage of each side. This makes it possible to adjust both of the articulated frames in the desired positions totally independently from each other.

In order to provide a better support for the foot rest 8 especially in the bed position, the foot rest may be provided with legs that can be folded out.

What is claimed is:

1. A piece of convertible seating furniture comprising:

a stationary body having a rear part, a front part and lateral parts extending from the rear part to the front part;

a stop in the rear part of the stationary body;

a transverse shaft mounted in the rear part of the body to extend transversely thereacross;

at least one articulated frame pivotally mounted on said body by said shaft and comprising:

a first frame part having opposite ends one of which is connected to said shaft;

stop members provided on said first frame part;

the stop members and stop being cooperable to prevent said first frame part from pivoting beneath a horizontal plane extending through said transverse shaft;

a rear, back part having opposite ends one of which is linked to the other end of the first frame part;

a front back part having opposite ends and significantly longer as measured between its ends than the rear back part with one end linked to the other end of said rear back part;

a seat part having opposite front and rear ends the rear end being linked to the other end of the front back part;

a carriage having front and rear ends;

pairs of wheels provided on respective front and rear ends of the carriage;

a front pair and a rear pair of seat supporting levers linking the seat part to the carriage;

linear wheel guides mounted in the lateral parts of the stationary body to extend between front and rear parts thereof in parallel inclined relation with uppermost points at the front part;

a foot rest having a foot supporting platform;

four pairs of interconnected, hinged levers linking the front end of said seat part to the foot rest;

a pair of connecting bars connecting one pair of said levers to the rear pair of seat supporting levers;

the piece of seating furniture being convertible from a normal sitting position in which the front and rear back parts are folded together and inclined at a small angle from the vertical plane, the foot rest platform is in a vertical position with the hinged levers thereof folded together closely adjacent the stationary body and the carriage in a rearmost position with the pair of wheels at the rear end engaging a lowermost rear part of the guide and the pair of wheels at the front end on a floor, to a floating rest position with the hinged levers of the foot rest in an unfolded condition and with the back part further inclined to the vertical and with the back part, the seat part and the foot rest cooperating to maintain the articulated frame in a balanced floating rest position;

and, further, to a conventional bed position in which the carriage has been drawn forwardly out of its rearmost position so that its rear pair of wheels is in the uppermost position of the guides and the articulated frame is unfolded downwardly to adopt a substantially horizontal unfolded condition with all the frame parts in substantially coplanar relation.

2. A piece of convertible seating furniture as claimed in claim 1, in which a lock member is mounted on a lower face of the foot rest platform and a complimentary lock member is mounted at the front part of the stationary body, the lock members being engageable to lock the articulated frame in a normal sitting position.

3. A piece of convertible seating furniture as claimed in claim 1, in which stop members are mounted at the top side of the first frame adjacent its link with the rear back part to prevent the first frame part and the rear back part being folded together beyond a minimum angle subtended therebetween.

4. A piece of convertible seating furniture as claimed in claim 3 in which the rear pair of seat supporting levers is shorter than the front pair of levers carrying the seat part.

5. A piece of convertible seating furniture as claimed in claim 4 in which the stationary body is provided with a stop or catch preventing unintentional withdrawal of the carriage to a forward position.

6. A piece of convertible seating furniture as claimed in claim 5 in which carrying members project upwardly from rear ends of the carriage into supporting engagement with the front back part when the articulated frame is unfolded to a horizontal, bed position.

7. A piece of convertible seating furniture as claimed in claim 5 including stop members on the front back part and the seat part engagable with respective parts to prevent the front back part and the seat part from subtending an upper angle exceeding 180°.

* * * * *